US005512346A

United States Patent [19]

Johnson

[11] Patent Number: 5,512,346

[45] Date of Patent: Apr. 30, 1996

[54] INSULATION ASSEMBLY FOR COMRPRESSIBLE INSULATION MATERIAL

[75] Inventor: Kenneth M. Johnson, Greer, S.C.

[73] Assignee: Owens-Corning Fiberglas Technology, Inc., Summit, Ill.

[21] Appl. No.: 310,179

[22] Filed: Sep. 21, 1994

[51] Int. Cl.[6] ..... B65D 85/08

[52] U.S. Cl. ..... 428/74; 428/906; 206/391; 206/417; 206/443

[58] Field of Search ..... 428/71, 74, 906; 206/391, 417, 443

[56] References Cited

U.S. PATENT DOCUMENTS

| | | | |
|---|---|---|---|
| 213,046 | 3/1879 | Hamlin | 206/417 |
| 3,220,583 | 9/1962 | Robertson | 214/152 |
| 4,203,273 | 5/1980 | Edgecombe | 53/399 |
| 5,137,153 | 8/1992 | Hendriks | 206/443 |
| 5,228,572 | 7/1993 | Hendriks | 206/443 |

FOREIGN PATENT DOCUMENTS

| | | | |
|---|---|---|---|
| 465815 | 1/1992 | European Pat. Off. | 206/391 |

*Primary Examiner*—Alexander S. Thomas
*Attorney, Agent, or Firm*—C. Michael Gegenheimer; Ted C. Gillespie

[57] ABSTRACT

An insulation assembly of the invention includes a central roll of compressed, rolled insulation material and six peripheral rolls of compressed, rolled insulation material surrounding the central roll, all of the rolls having longitudinal axes in parallel, each of the rolls being individually restrained, and the entire assembly being enclosed in a wrapper.

18 Claims, 3 Drawing Sheets

FIG. 1
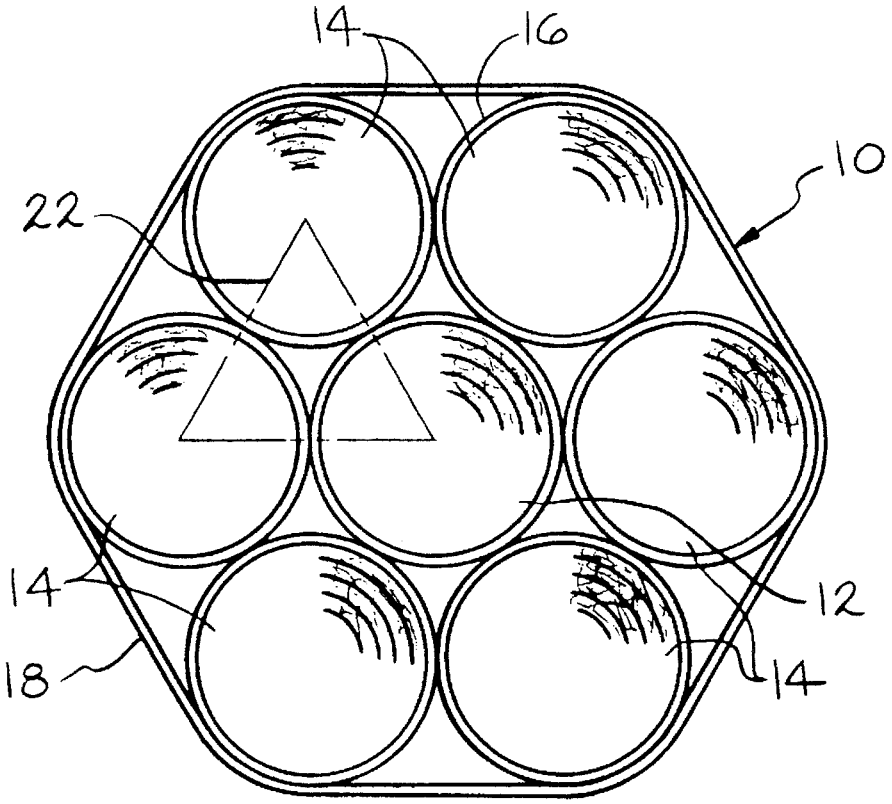
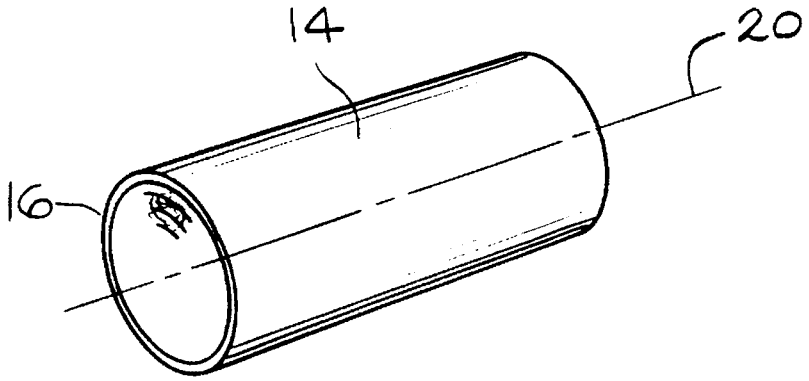
FIG. 2

INSULATION ASSEMBLY FOR COMRPRESSIBLE INSULATION MATERIAL

TECHNICAL FIELD

This invention relates to packaging compressible material. More particularly, the invention pertains to an insulation assembly having a plurality of individually wrapped or restrained insulation rolls.

BACKGROUND

Insulation material for buildings is routinely compressed during packaging for more efficient shipping. Usually the insulation material contains a high percentage of air cells or voids, and these are reduced in size during the compression process. Typical compression ratios provide a recovered thickness within the range of from about 4 to about 7 times the compressed thickness. Recent improvements have enabled compression ratios of between about 12 and about 20 or higher.

One of the aspects of insulation packages having the higher compression ratios (i.e., above 10) is that the packages are considerably smaller than typical packages, particularly when the typical package square foot coverage is maintained. For example, a conventional R25 PINKPLUS® insulation product (15 inch) covers about 32 square feet of attic floor, and in the rolled up condition with a compression ratio of about 7:1 has a diameter of about 22 inches. In comparison, a higher compression ratio product (15:1) has a rolled package diameter of about 14 inches for the same square feet of attic floor coverage. This improved compactness provides the expected advantage of enabling more insulation material to be carried in each truck or railcar. However, the smaller packages present handling problems, especially when the insulation is packaged in rolls rather than in bags.

What is required is a way to handle several of the compact insulation rolls at once. Simply collecting or assembling several rolls together presents some problems. The assembly must be stable, i.e., not susceptible of having the insulation rolls shift within the assembly. An assembly of four rolls placed in a square orientation, for example, tends to shift to a parallelogram configuration. The insulation assembly must be sufficiently stable to enable stacking of several assemblies on top of one another for efficient storage without the use of racks. Also, the assembly must not be so heavy that it is difficult or impossible for the insulation contractor to roll or cartwheel the insulation assembly end over end from place to place. Cartwheeling is lifting one end of the assembly and rotating it about the other end of the assembly. Further, the insulation assembly must be densely packed with the individual insulation rolls so that the maximum amount of insulation material can be placed within the cargo or storage space. There is a need for an improved insulation assembly.

DISCLOSURE OF INVENTION

There has now been developed an improved insulation assembly which meets all of the above criteria. The insulation assembly comprises a central roll and six peripheral rolls of insulation material, all of the rolls having longitudinal axes in parallel and each of the rolls being individually restrained or packaged, with the entire assembly being enclosed in a wrapper. The insulation assembly is a stable package which will not allow the individual rolls to shift within the assembly. The assembly is densely packed, thereby providing efficient transportation and storage, and enabling a multiplicity of the assemblies to be stacked on top of each other. The insulation assembly of the invention can be cartwheeled easily.

In a specific embodiment of the invention, each roll has a diameter within the range of from about 7 to about 14 inches, and a density within the range of from about 6 to about 20 pcf.

In another specific embodiment of the invention, the assembly has a nominal diameter within the range of from about 20 to about 36 inches. Preferably, the assembly has a nominal diameter within the range of from about 20 to about 32 inches.

In a preferred embodiment of the invention, the insulation assembly is cartwheelable. Each roll can be comprised of a rolled up encapsulated insulation blanket.

In yet another embodiment of the invention, the ratio of major face edge dimensions is less than about 1:1.5, and preferably less than about 1:1.3.

In another embodiment of the invention, the insulation assembly comprises more than three rolls of compressed, rolled insulation material, each of the rolls being individually restrained, each roll being in contact with at least two adjacent rolls to substantially form an equilateral triangle, all of the rolls having longitudinal axes in parallel, and the entire assembly being enclosed in a wrapper. By having each roll in contact with at least two adjacent rolls in the form of an equilateral triangle the package is in a very stable configuration.

BRIEF DESCRIPTION OF DRAWINGS

FIG. 1 is a schematic plan view of an insulation assembly of the invention.

FIG. 2 is a schematic view in perspective of an individual roll of insulation material contained in the insulation assembly of FIG. 1.

BEST MODE FOR CARRYING OUT THE INVENTION

Figure 3:
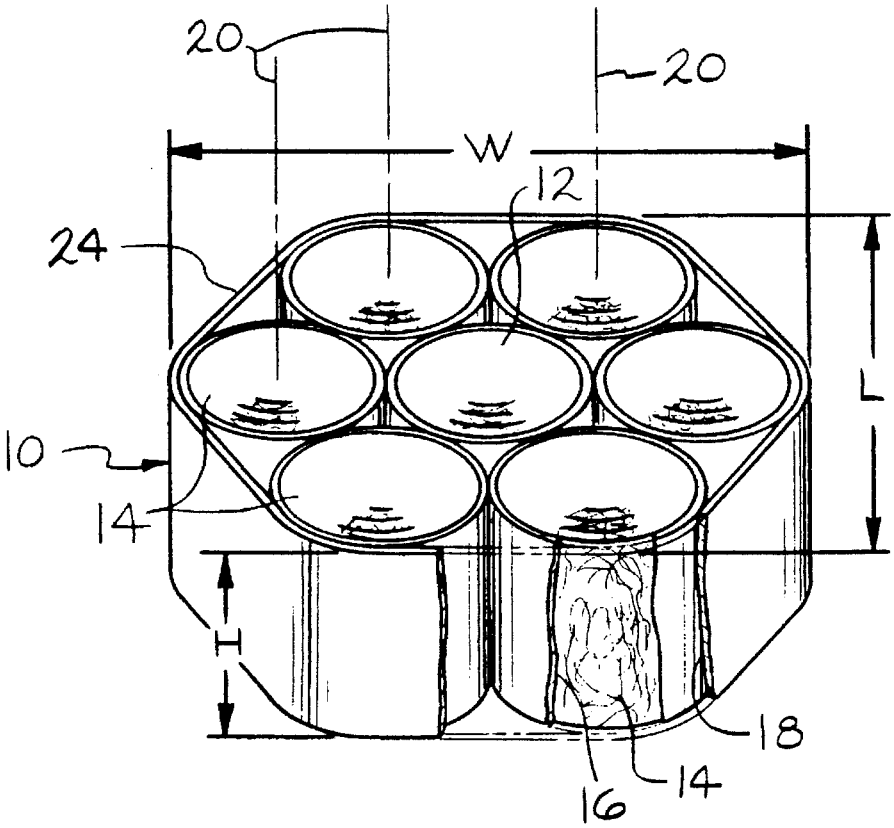
FIG. 3 is a perspective view of the insulation assembly of FIG. 1, with a portion of the assembly and individual roll wrappers cut away.

The invention will be described with reference to an assembly for packaging fiberglass insulation. It is to be understood, however, that the invention can apply equally to other mineral fiber insulation materials, as well as other compressible insulation materials such as foams.

As shown in FIG. 1, insulation assembly 10 is generally comprised of central roll 12 of compressed, rolled insulation material surrounded by peripheral rolls 14 of the same compressed, rolled insulation material. The insulation material can be a light density, 0.4 pounds per cubic foot (pcf) blanket, which optionally can be encapsulated, as is known in the art. The insulation material can be rolled up by any suitable means, many of which are well known in the art. A preferred roll up apparatus is one that uses a mandrel and a pair of opposed belts surrounding the mandrel, where the tension in the belts is controlled to apply a generally constant pressure to the insulation being rolled up.

Each individual roll is individually restrained, i.e., kept from unrolling. Preferably this is accomplished by an individual roll wrapper of a thin, strong plastic film, such as roll wrapper 16 made of 4 mil high density linear polyethylene. Alternatively, the restraint can be a pair of 2 inch wide paper bands, or by other means. The insulation material can be of any density, but preferably has a density in the rolled condition within the range of from about 6 to about 20 (pcf), prior to being placed in the insulation assembly. Preferably, each roll has a diameter within the range of from about 7 to about 14 inches.

The insulation assembly is enclosed in a wrapper, such as assembly wrapper 18, which can be any suitable wrapper for maintaining the individual rolls in the assembly. Preferably, the assembly wrapper is made of 1.2 mil polyethylene stretch wrap film. The application of the assembly wrapper further compacts the insulation material in the individual rolls, slightly increasing the density of the rolls. Preferably, the insulation assembly has a diameter within the range of from about 20 to about 36 inches. Diameter is measured using the long dimension, i.e., W in FIG. 3. Although the insulation assembly is shown with the wrapper positioned circumferentially around the assemblage of individual rolls, the wrapper can also be wrapped completely around the insulation assembly, covering the top, bottom and all sides.

As shown in FIGS. 2 and 3, each individual roll 14 can be viewed as having a central or longitudinal axis 20. The rolls in the insulation assembly are oriented so that all of the rolls have longitudinal axes in parallel.

The individual rolls of insulation are aligned in such a way that there is intimate contact with at least two neighboring rolls of insulation. When the insulation assembly is comprised of a central roll and six peripheral rolls, the central roll is in intimate contact with all six of the peripheral rolls, and each peripheral roll is in intimate contact with the central roll and two other peripheral rolls. As can be seen in FIG. 1, each set of three adjacent rolls forms a triangle, triangle 22 in insulation assembly major face 24, which is roughly equilateral. As used herein, the term "substantially form an equilateral triangle" means that lines connecting the longitudinal axes of three adjacent rolls of insulation in a plane of the major face of the insulation assembly would form a triangle which is substantially an equilateral triangle, i.e., having no interior angle greater than about 70 degrees. Preferably, all three interior angles are about 60 degrees.

Figure 4:
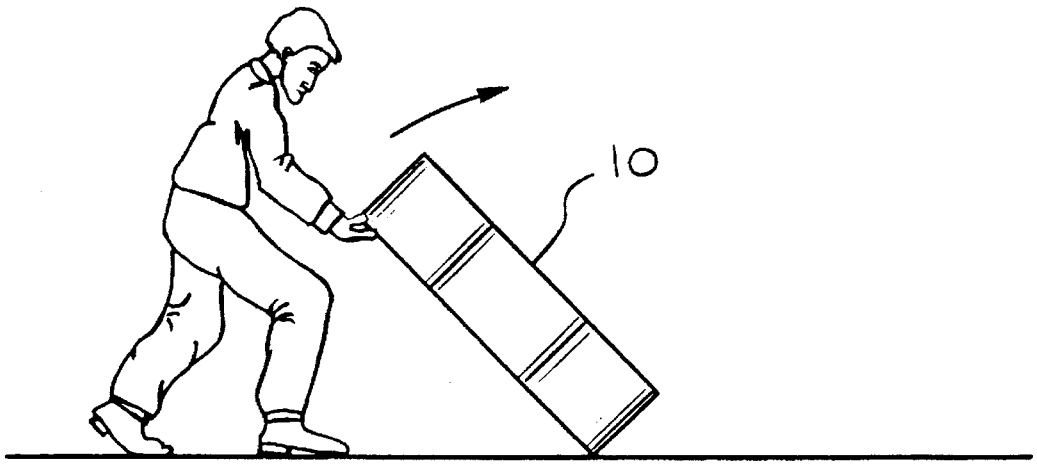
FIG. 4 is an elevational view illustrating an insulation assembly being cartwheeled.
Figure 5:
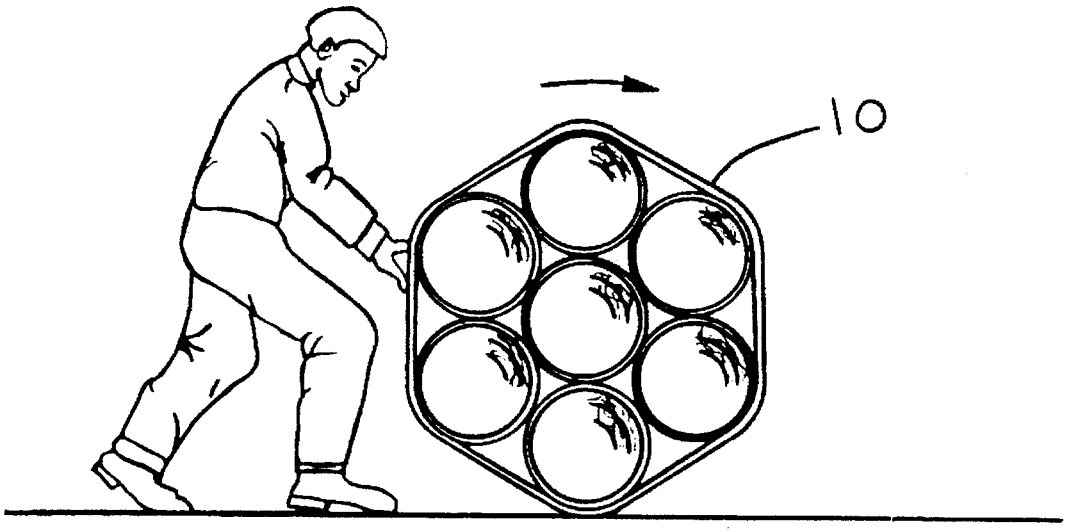
FIG. 5 is an elevational view illustrating an insulation assembly being cartwheeled by rolling.

As shown in FIG. 3, the insulation assembly can be viewed as having length L, width W, and height H. It has been found that the insulation assembly must have a relatively square face in order for it to be manually turned end over end or cartwheeled from one location to another. It has been found that if the major face of the insulation assembly is rectangular with one of the edge dimensions substantially larger than the other edge dimension, the package is not readily manually cartwheelable by an installer, and therefore does not meet the customer's fitness-for-use requirements. Therefore it is preferred that the length L and width W be nearly equal to enable the insulation assembly to be cartwheeled. The ratio of the major face edge dimensions L and W is preferably less than about 1:1.5, and most preferably less than 1:1.3. By using a nearly hexagonal configuration, the insulation assembly can actually be rolled, as shown in FIG. 5. If the length and height are not too different, or if the insulation assembly is not too heavy, the insulation assembly can be cartwheeled height over length, as shown in FIG. 4. A further advantage of the hexagonal shape of the insulation assembly is that the hexagonal shape provides for more compact packing in the truck or railcar since the insulation assemblies nest in a staggered fashion. Placing the hexagonal-shaped insulation assemblies in a truck or railcar provides a very stable configuration which resists load shifting and does not require dunnage.

It will be evident from the foregoing that various modifications can be made to this invention. Such, however, are considered as being within the scope of the invention.

INDUSTRIAL APPLICABILITY

The invention can be useful in the packaging of insulation materials used for thermal and acoustical insulation.

I claim:

1. An insulation assembly comprising a central roll of compressed, rolled insulation material and six peripheral rolls of compressed, rolled insulation material surrounding the central roll, all of the rolls having longitudinal axes in parallel, each of the rolls being individually restrained, each roll being comprised of a rolled up encapsulated insulation blanket, and the entire assembly being enclosed in a wrapper.

2. The insulation assembly of claim 1 in which each roll has a diameter within the range of from about 7 to about 14 inches, and a density within the range of from about 6 to about 20 pcf.

3. The insulation assembly of claim 2 in which the assembly has a nominal diameter within the range of from about 20 to about 36 inches, and each roll has a density within the range of from about 10 to about 16 pcf.

4. The insulation assembly of claim 1 in which the assembly has a nominal diameter within the range of from about 20 to about 36 inches, and each roll has a density within the range of from about 6 to about 20 pcf.

5. The insulation assembly of claim 1 in which the insulation assembly is cartwheelable.

6. The insulation assembly of claim 1 in which the ratio of major face edge dimensions is less than about 1:1.5.

7. The insulation assembly of claim 6 in which the ratio of major face edge dimensions is less than about 1:1.3.

8. An insulation assembly comprising more than three rolls of compressed, rolled insulation material, each of the rolls being individually restrained, each roll being in contact with at least two adjacent rolls to substantially form an equilateral triangle, each roll being comprised of a rolled up encapsulated insulation blanket, all of the rolls having longitudinal axes in parallel, and the entire assembly by being enclosed in a wrapper.

9. The insulation assembly of claims 8 in which each roll has a diameter within the range of from about 7 to about 14 inches, and a density within the range of from about 6 to about 20 pcf.

10. The insulation assembly of claim 8 in which the assembly has a nominal diameter within the range of from about 20 to about 36 inches, and each roll has a density within the range of from about 6 to about 20 pcf.

11. The insulation assembly of claim 10 in which the assembly has a nominal diameter within the range of from about 20 to about 36 inches, and each roll has a density within the range of from about 10 to about 16 pcf.

12. The insulation assembly of claim 8 in which the insulation assembly is cartwheelable.

13. The insulation assembly of claim 8 in which the ratio of major face edge dimensions is less than about 1:1.5.

14. The insulation assembly of claim 13 in which the ratio of major face edge dimensions is less than about 1:1.3.

15. An insulation assembly comprising a central roll of compressed, rolled insulation material and six peripheral rolls of compressed, rolled insulation material surrounding the central roll, each roll being a rolled up, encapsulated insulation blanket, all of the rolls having longitudinal axes in parallel, each of the rolls being individually restrained, and the entire assembly being enclosed in a wrapper, the ratio of major face edge dimensions being less than about 1:1.5.

16. The insulation assembly of claim 15 in which each roll has a diameter within the range of from about 7 to about 14 inches, and a density within the range of from about 6 to about 20 pcf.

17. The insulation assembly of claim 15 in which the insulation assembly is cartwheelable.

18. The insulation assembly of claim 15 in which the ratio of major face edge dimensions is less than about 1:1.3.

* * * * *